US006578244B2

(12) United States Patent
Tanaka et al.

(10) Patent No.: US 6,578,244 B2
(45) Date of Patent: Jun. 17, 2003

(54) DIRECT-WINDING SAMPLE WARPER

(75) Inventors: Yoshihiro Tanaka, Kiryu (JP); Takatsugu Aihara, Kiryu (JP)

(73) Assignee: Suzuki Warper Ltd., Gunma-ken (JP)

( * ) Notice: Subject to any disclaimer, the term of this patent is extended or adjusted under 35 U.S.C. 154(b) by 0 days.

(21) Appl. No.: 09/983,927

(22) Filed: Oct. 26, 2001

(65) Prior Publication Data

US 2002/0050038 A1 May 2, 2002

(30) Foreign Application Priority Data

Oct. 27, 2001 (JP) ..... 2000-329391

(51) Int. Cl.[7] ..... D02H 9/02
(52) U.S. Cl. ..... 28/190
(58) Field of Search ..... 28/185, 190, 198, 28/200, 192, 191, 195

(56) References Cited

U.S. PATENT DOCUMENTS 4,972,562 A * 11/1990 Tanaka et al. ..... 242/472.8
5,630,262 A * 5/1997 Tanaka ..... 28/184
5,950,289 A * 9/1999 Tanaka ..... 28/184
5,970,591 A * 10/1999 Tanaka et al. ..... 28/184
6,173,480 B1 * 1/2001 Tanaka ..... 28/190
6,199,787 B1 * 3/2001 Jaffar et al. ..... 242/418.1
6,233,798 B1 * 5/2001 Bogucki-Land ..... 28/190

* cited by examiner

*Primary Examiner*—Danny Worrell
(74) *Attorney, Agent, or Firm*—Arent Fox Kintner Plotkin & Kahn, PLLC

(57) ABSTRACT

There is provided a direct-winding sample warper comprising: a warper drum; yarn winding means mounted on a circumferential surface of the warper drum so as to be rotatable circumferentially and movable longitudinally on the warper drum; a yarn selector provided in correspondence to the yarn winding means; and a plurality of parallel shedding means extending longitudinally and parallel each other on the side of the warper drum; wherein the yarn winding means is operable to directly wind at least one yarn, which is payed out from a creel on which bobbins are supported, around the circumferential surface of the warper drum. In the direct-winding sample warper, a yarn is wound directly on a warper drum by a yarn winding means without using a conveyer belt so that various inconveniences due to the conventional conveyer belt can be entirely eliminated.

30 Claims, 15 Drawing Sheets

An orderly winding condition of six windings (1-2-3-4-5-6) using one yarn according to the present invention An orderly winding condition of six windings (1-2-3-4-5-6) using eight yarns according to the present invention

DIRECT-WINDING SAMPLE WARPER

BACKGROUND OF THE INVENTION

1. Field of the Invention

This invention relates to a novel direct-winding sample warper capable of orderly warping by which a yarn is wound directly on a circumferential surface of a warper drum.

2. Description of Related Art

Conventional electronically controlled sample warpers of the described type are exemplified by Japanese Patents Nos. 1,529,104 and 1,767,706 (U.S. Pat. No. 4,972,662 and European Patent No. 035480). The first-named Japanese publication discloses a sample warper W as shown in FIG. 13 of the accompanying drawings. The sample warper W of FIG. 13 comprises: a yarn guide 6 rotatably mounted on one side surface of a warper drum A for winding a yarn on the warper drum A;, a yarn selector 27 having a plurality of yarn selection guides (not shown) associated with the yarn guide 6 and mounted on an end of a base Y supporting the warper drum A for association with the yarn guide 6 and for moving angularly to project to an operative position when exchanging yarns and restore to a standby position when accommodating yarns; a fixed creel B for supporting a plurality of bobbins N, which are associated with the plural yarn selection guides of the yarn selector 27 and on which various kinds or a single kind of yarns 22 are to be wound, thereby confirming transferring of the yarns 22 between the yarn guide 6 and the yarn selector 27 so that the yarns are automatically changed and successively wound neatly on the warper drum A in a preset sequence.

In the sample warper W, the plural yarn selection guides of the yarn selector 27 receive the plural yarns 22, respectively, so that the individual yarns 22 of the fixed creel B can be successively wound on the warper drum W in a fully controlled manner. Reference numeral 17 designates a plurality of conveyer belts movably mounted on a circumferential surface of the warper drum A.

The second-named Japanese publication discloses another sample warper W for winding a plurality of yarns simultaneously as shown in FIG. 14. The sample warper W of FIG. 14 has a plurality of yarn guides 6*a*–6*h* (8 yarn guides are shown in FIG. 14) for winding a plurality of yarns 22, which are payed out from a rotary creel F, on the conveyer belts 17.

Each of the sample warpers W shown in FIGS. 13 and 14 has a plurality of parallel shedding means (a plurality of parallel shedding bars 18*a*–18*g*) extending longitudinally and parallel each other on the side of the warper drum A. The basic structure and operation of the sample warpers W are well known as by the above-mentioned Japanese publications, so their detailed description is omitted here.

Japanese Patent No. 2854789 discloses a sample warper capable of winding a yarn orderly in successive turns independently of a number of turns so as to make a long sample or a small lot of product, namely, flexible manufacturing. The basic structure and operation of this sample warper are described in the above-mentioned Japanese publications, so their detailed description is omitted here.

In continuous-length warping (in which an increased number of turns increases) orderly in successive turns using the above-mentioned individual conventional sample warpers, a yarn 22 is wound directly on the conveyer belts 17l as shown in FIG. 15. In FIG. 15, reference numeral 16 designates a drum spoke, on which a conveyer belt 17 is movably mounted. Reference character G designates guide means for winding a yarn orderly in successive turns, and reference numeral 100 designates a bracket for attaching the guide means G on a base end of the conveyer belt 17. Since the yarn 22 is tightened on the conveyer belts 17 with a considerable amount of tension as the yarn 22 wound on the conveyer belts 17 becomes longer, the conveyer belts 17 cannot move smoothly. These conventional sample warpers are therefore disadvantageous because they require a considerable amount of power so as to drive the conveyer belts to move stably.

In addition, when such sample warpers make orderly warping of a stretch yarn in successive turns, the tension on the conveyer belts 17 would be very large during orderly warping of a stretch yarn, so that the brackets 100 of the guide means G need to have enough strength to withstand such large amount of tension. Thus as the demand for flexible manufacturing is presumably on the rise in future, the above-described conventional sample warpers would be unable to warp various kinds of yarns practically.

SUMMARY OF THE INVENTION

With the foregoing problems in view, it is an object of the present invention to provide a novel direct-winding sample warper in which a yarn is wound directly on a warper drum by a yarn winding means without using a conveyer belt so that various inconveniences due to the conventional conveyer belt can be entirely eliminated.

In order to attain the above object, according to a generic feature of the present invention, there is provided a direct-winding sample warper comprising: a warper drum; yarn winding means mounted on a circumferential surface of the warper drum so as to be rotatable circumferentially and movable longitudinally on the warper drum; a yarn selector provided in correspondence to the yarn winding means and movable in synchronism with the longitudinal movement of the yarn winding means; and a plurality of parallel shedding means extending longitudinally and parallel each other on the side of the warper drum and movable in synchronism with the longitudinal movement of the yarn winding means; wherein the yarn winding means is operable to directly wind at least one yarn, which is payed out from a creel on which bobbins are supported, around the circumferential surface of the warper drum.

Preferably, the circumferential surface of the warper drum is defined by a plurality of drum spokes, each having at its base end an outer surface on which a pillow member having a taper surface slanting down to its tip is disposed, so that winding the yarn around the circumferential surface of the warper drum starts from the pillow members on the respective bases of the drum spokes and terminates at other ends of the drum spokes remote from the pillow members.

As another preferable feature, the yarn winding means may include at least one yarn guide member attached to a drive belt or chain circumferentially rotatably mounted on the circumferential surface of the warper drum.

When a yarn is wound using one yarn guide member of the yarn winding means, the yarn winding means, the yarn selector, the orderly winding guide means and the shedding means are intermittently or continuously moved in time with progress of the warping on the basis of a warping yarn pitch R=warping width÷total number of yarns (number of yarns to be warped).

When a plurality of yarns are wound using a plurality of yarn guide members of the yarn winding means, the yarn winding means, the yarn selector, the orderly winding guide means and the shedding means are intermittently or continuously moved in time with progress of the warping on the basis of a warping yarn pitch $R_N$=warping width÷(total number of yarns÷number of yarns to be simultaneously warped N).

As still another preferable feature, the yarn selector may transfer the yarn from the creel between the yarn selector and the yarn guide members in accordance with previously input pattern data by delivering the yarn to the yarn guide members and receiving the yarn from the yarn guide members.

The yarn winding means may be associated with the orderly winding guide means each having an orderly winding guide member, so that the yarn is successively wound neatly on the warper drum in regular order. It is preferable that the orderly winding guide member is longitudinally slidably mounted on the warper drum.

When a yarn is wound using one yarn guide member of the yarn winding means, the orderly winding guide member is moved toward the pillow member by a distance P which is at least a half of the thickness or diameter of the yarn for each revolution of the yarn guide member, and when the number of revolutions of the yarn guide member reaches a preset multi-winding value, the orderly winding guide members are rapidly moved back by a distance Q which is equal to the product of the distance P and the preset multi-winding value. Concurrently therewith, the yarn winding means, the yarn selector, the warping guide means and the shedding means are intermittently or continuously moved in time with progress of the warping on the basis of a warping yarn pitch R=warping width÷total number of yarns (number of yarns to be warped). Thus, the yarn can be wound on the warper drum with windings of yarn neatly layered one on another in regular order.

When a plurality of yarns are wound using a plurality of yarn guide members of the yarn winding means, the orderly winding guide members are moved toward the pillow members by a distance $P_N$ which is at least a half of the thickness or diameter of a bundle of the plural yarns for each revolution of the yarn guide members, and when the number of revolutions of the yarn guide members reaches a preset multi-winding value, the warping guide members are rapidly moved back by a distance $Q_N$ which is equal to the product of the distance $P_N$ and the preset multi-winding value. Concurrently therewith, the yarn winding means, the yarn selector, the warping guide means and the shedding means are intermittently or continuously moved in time with progress of the warping on the basis of a warping yarn pitch $R_N$=warping width÷(total number of yarns÷number of yarns to be simultaneously warped N). Thus, the yarns can be wound on the warper drum with windings of yarn neatly layered one on another in regular order.

DESCRIPTION OF THE PREFERRED EMBODIMENT(S)

Embodiments of the present invention will be explained below with reference to the drawings. These embodiments are merely illustrative, and the present invention may be modified or changed variously without departing the scope or spirit of the technical idea of the present invention or the appended claims.

Figure 1:
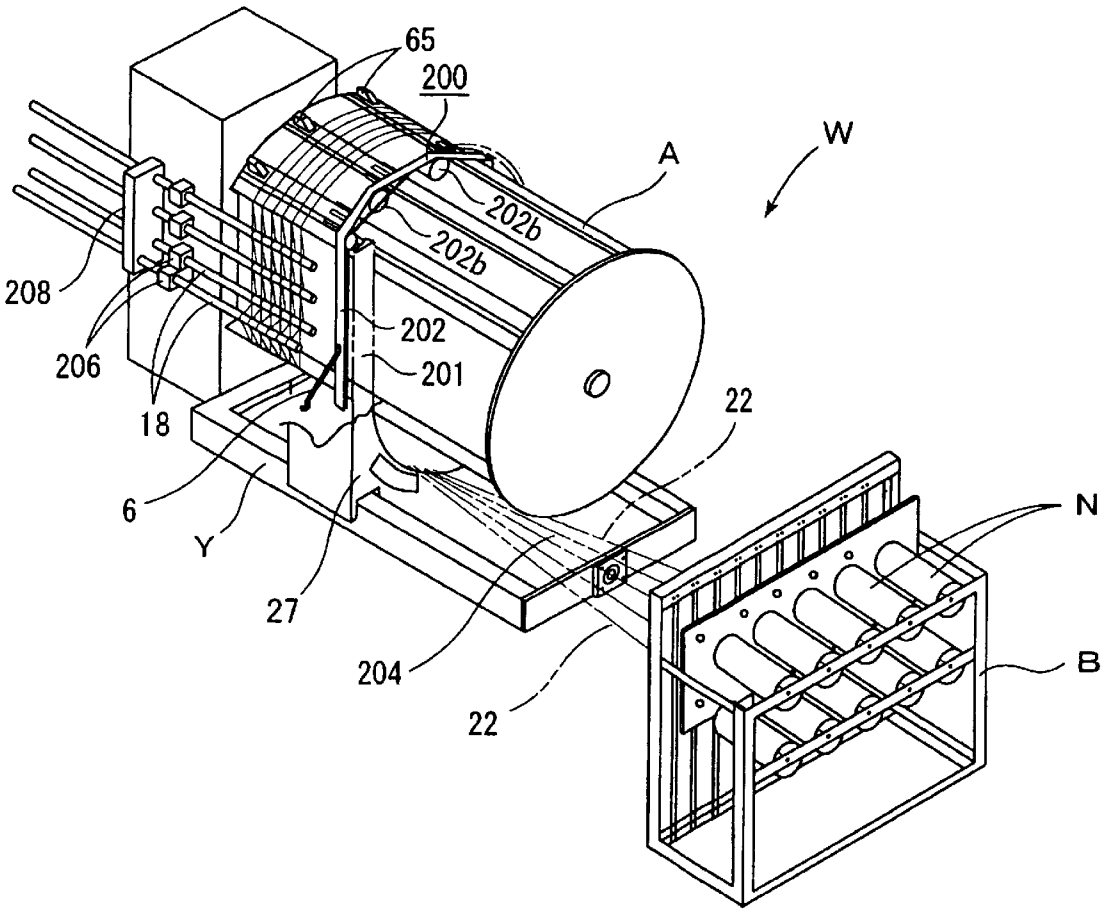
FIG. 1 is an explanatory perspective view showing an embodiment of a direct-winding sample warper according to the present invention.
Figure 2:
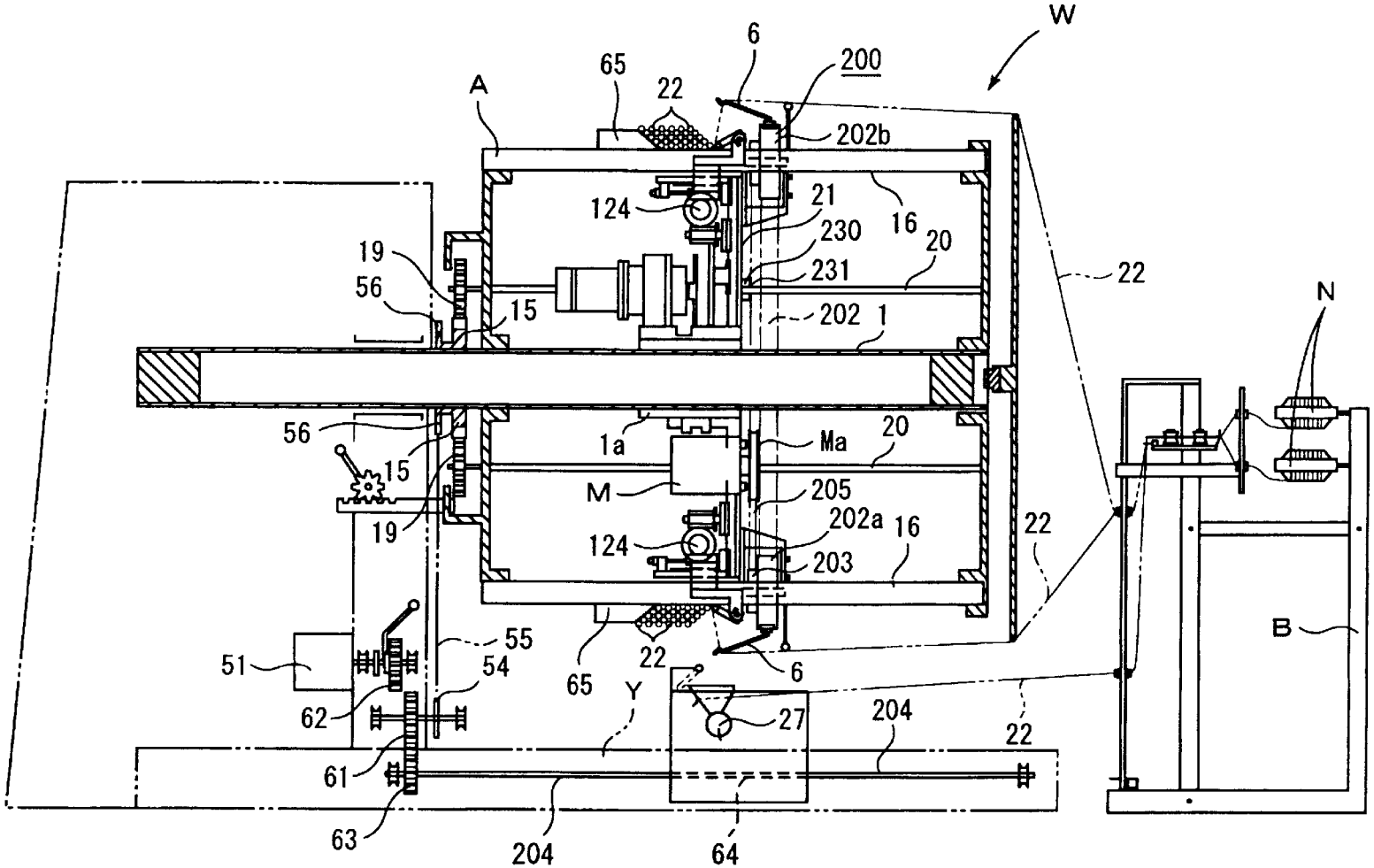
FIG. 2 is an explanatory cross-sectional view of FIG. 1.

FIG. 1 is a perspective view showing a direct-winding sample warper according to one embodiment of the present invention; FIG. 2 is a cross-sectional view of FIG. 1; and FIG. 3 is a side view of FIG. 1.

In the drawings, W designates a sample warper according to the present invention which comprises a warper drum A and a yarn winding means 200 mounted on a circumferential surface of the warper drum A so as to be rotatable circumferentially and movable longitudinally on the warper drum A.

Figure 3:
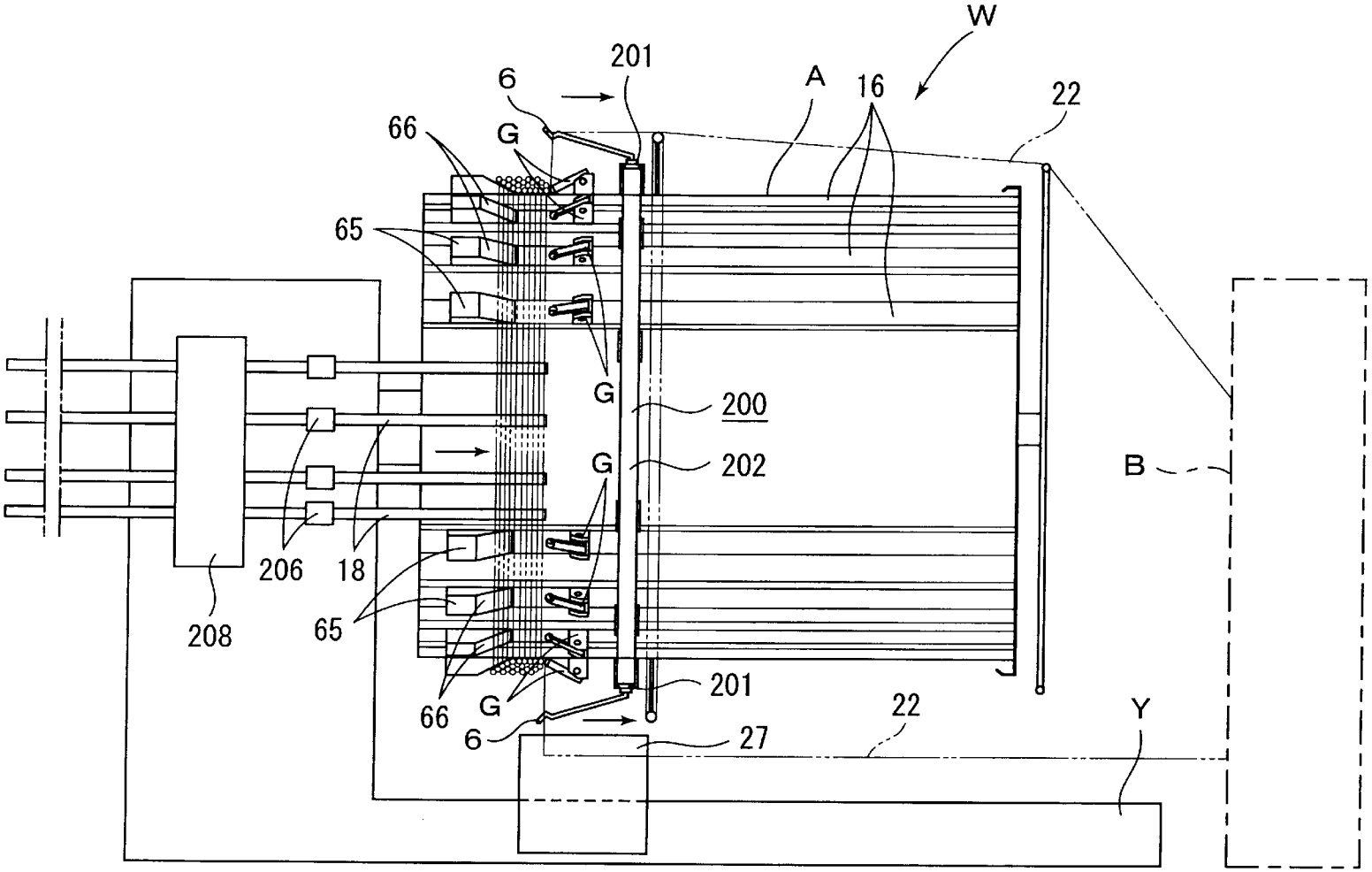
FIG. 3 :s an explanatory side view of FIG. 1.

As the yarn winding means 200, at least one yarn guide member 6 (FIGS. 1–3 show an embodiment that two yarn guide means are used but in FIG. 1 one of them is omitted.) which is attached on the upper surface of a fixed member 201 fixed on a drive belt 202 (or a chain with an attachment) is preferably used. The drive belt 202 (or the chain with an attachment) is circumferentially rotatably mounted on the circumferential surface of the warper drum A, namely on the outer surface of the drum spokes 16.

Referring first to FIG. 2, M designates a drive motor to rotate the drive belt 202, and a motor pulley Ma is provided on the drive motor M. A movable drum 1*a* is longitudinally slidably attached on a main axis 1. The movable drum 1*a* has a plurality of movable arms 21, 21 radially provided therein. A drive pulley 202*a* and a driven pulley 202*b* for suspending and guiding the drive belt 202 are fixed at the distal ends of the movable arms 21, 21.

Reference numeral 203 designates a small pulley coaxially rotating with the pulley 202*a*. The small pulley 203 is connected via the motor pulley Ma and a pulley belt 205. Thus, when the drive motor M is on, the drive pulley 202*a* is rotated via the motor pulley Ma, the pulley belt 205 and the small pulley 203. Concurrently therewith, the drive belt 202 is rotated via the driven pulley 202*b,* so that the yarn guide member 6 is rotated to wind the yarns 22 on the warper drum A, namely on the drum spokes 16.

Reference numerals 230, 230 indicate screw nuts provided on the middle portion of the movable drum 1*a*. Screw runners 231 are tapped in the centers of the screw nuts 230, 230, and screw rods 20, 20 are screwed therein. The movable drum 1*a* and the movable arms 21 are moved by the rotation of the screw rods 20, 20. The movement of the movable drum 1*a* and the movable arms 21 make it possible to move the drive belt 202 in the longitudinal direction.

The base ends of the screw rods 20, 20 are connected to planetary gears 19, and the planetary gears 19 are in mesh with a sun gear 15 rotating the outer periphery of the main axis 1. A chain wheel 56 is associated with the sun gear 15, and a sprocket wheel 54 is connected with the chain wheel 56 via a chain 55. The sprocket wheel 54 is coaxially connected with an intermediate gear 61. The intermediate gear 61 is meshable with a motor gear 62 of an AC servomotor 51. The rotation of the AC servomotor 51 leads to the rotation of the screw rods 20, 20 via the motor gear 62, the intermediate gear 61, the sprocket wheel 54, the chain 55, the chain wheel 56, the sun gear 15 and the planetary gears 19, thereby the movable drum 1*a* being moved in the longitudinal direction.

Reference numeral 63 indicates a drive gear, which is provided at a base end of a guide screw rod 204 and is meshed with the intermediate gear 61. Thus, when the AC servomotor 51 is on, the guide screw rod 204 is rotated via the motor gear 62, the intermediate gear 61 and the drive gear 63, and a yarn selector 27 is moved in the longitudinal direction in company with the rotation of the guide screw rod 204. At this time, since the rotation of the servomotor 51 is transmitted to both the movable drum 1*a* and the yarn selector 27 via the intermediate gear 61, they move synchronously in the longitudinal direction by the same distance.

Figure 4:
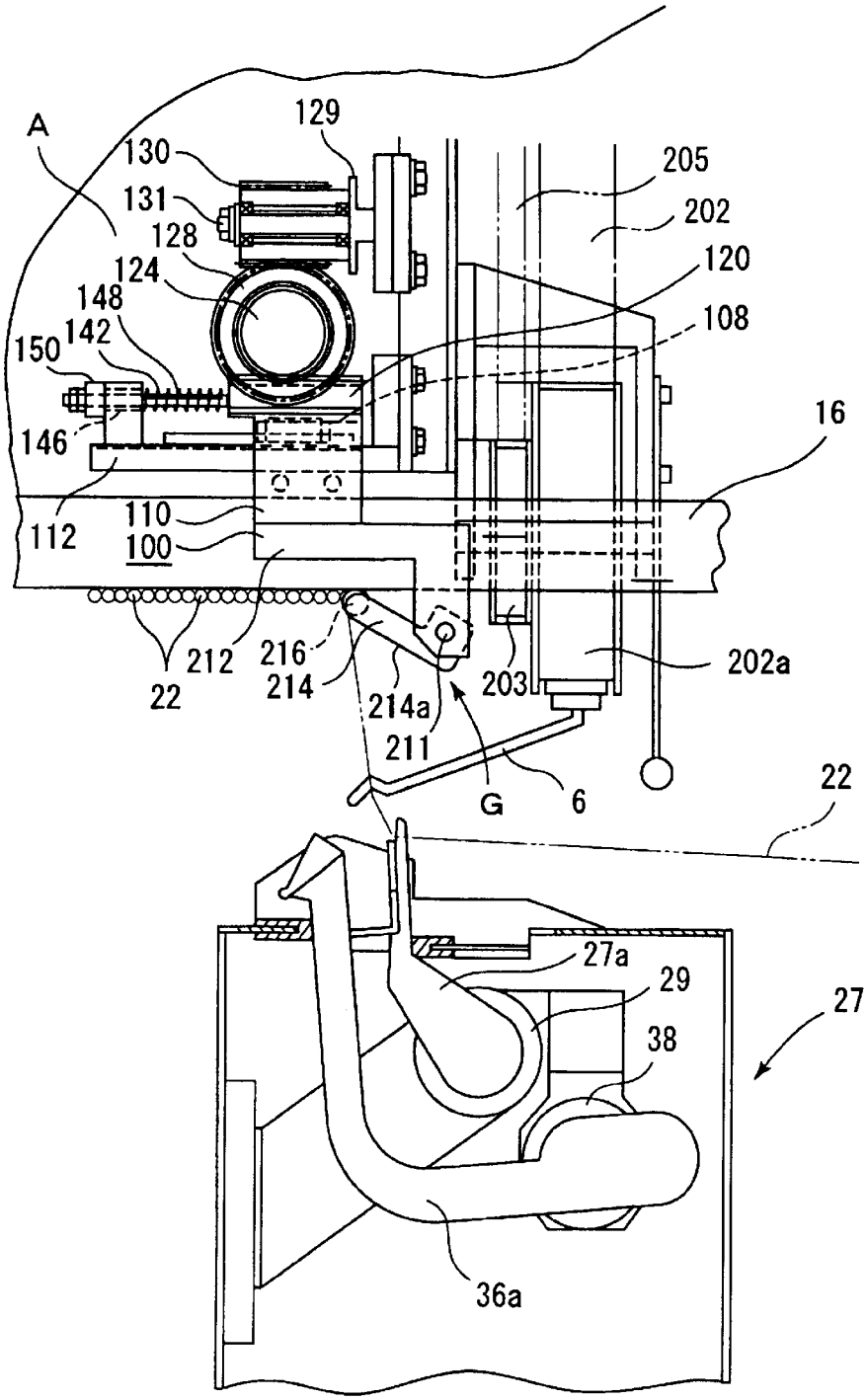
FIG. 4 is an explanatory schematic view of an embodiment of a yarn selector showing a yarn selection guide which holds a yarn and has angularly moved to a yarn exchanging position.

Reference numeral 27 designates a yarn selector. As the yarn selector 27, there is used such as a known one as shown in the Japanese Laid-open Publication No. 11-293536, for example, a yarn selector illustrated in FIG. 4. In FIG. 4, the yarn selector 27 has a plurality of yarn selection guides 27*a*–27*h* (only 27*a* is illustrated in FIG. 4), and each of the yarn selection guides 27*a*–27*h* is pivotally moved to project to an operative position (a yarn exchanging position) when exchanging yarns and restore to a standby position (a yarn accommodating position) when accommodating yarns, respectively, by a selection solenoid 29 so that yarns 22 are exchanged.

The yarn selector 27 is provided on the base Y below the warper drum A in correspondence to the yarn winding means 200. The yarn selector 27 is longitudinally and slidably provided on the base Y with the guide screw rod 204 attached in the base Y and a screw runner 64 tapped in an appropriate location of the yarn selector 27, so that the yarn selector 27 is movable in synchronism with the longitudinal movement of the yarn winding means 200.

Yarn removing guides 36*a*–36*h* (only 36*a* is illustrated in FIG. 4) are positioned to form pairs with the yarn selection guides 27*a*–27*h,* respectively. Each of the yarn removing guides 36*a*–36*j* is pivotally moved to an operative position (a yarn removing position) and an inoperative position (a standby position), respectively, for performing a yarn removing operation by a corresponding yarn removing solenoid 38 positioned near the selection solenoid 29.

As a yarn selector 27, other than the yarn selector 27 illustrated in FIG. 4, there may be used a conventional one in which a yarn removing member is constructed as a separate body.

In FIG. 3, reference numeral 18 indicates a plurality of parallel shedding bars (the illustrated embodiment shows four shedding bars mounted on the side of the warper drum A) extending longitudinally and parallel each other on the side of the warper drum A. The shedding bars 18 are held by holding members 206 and are moved in synchronism with the longitudinal movement of the yarn winding means 200, so that the shedding bars 18 are able to move, shedding the yarns 22 which are wound on the warper drum A.

Designated by B is a fixed creel, which are associated with the plural yarn selection guides 27*a*–27*h* of the yarn selector 27, for supporting a plurality of bobbins N, on which various kinds or a single kind of yarns 22 are to be wound (FIG. 1).

Designated by G are orderly winding guide means attached to the yarn winding means 200 for guiding the yarns 22 from the yarn guide members 6.

Figure 5:
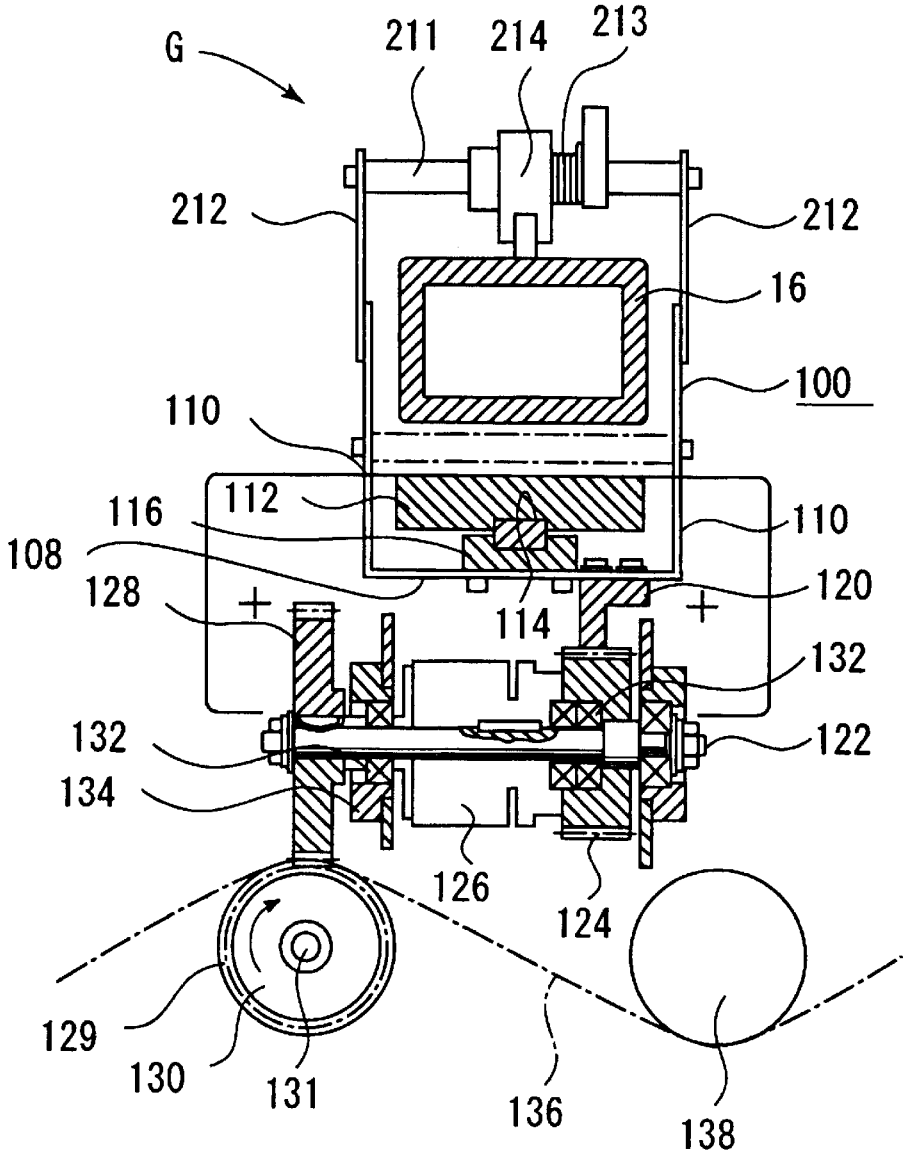
FIG. 5 is an explanatory cross-sectional view of an orderly winding guide means moving mechanism of the present invention.
Figure 9:
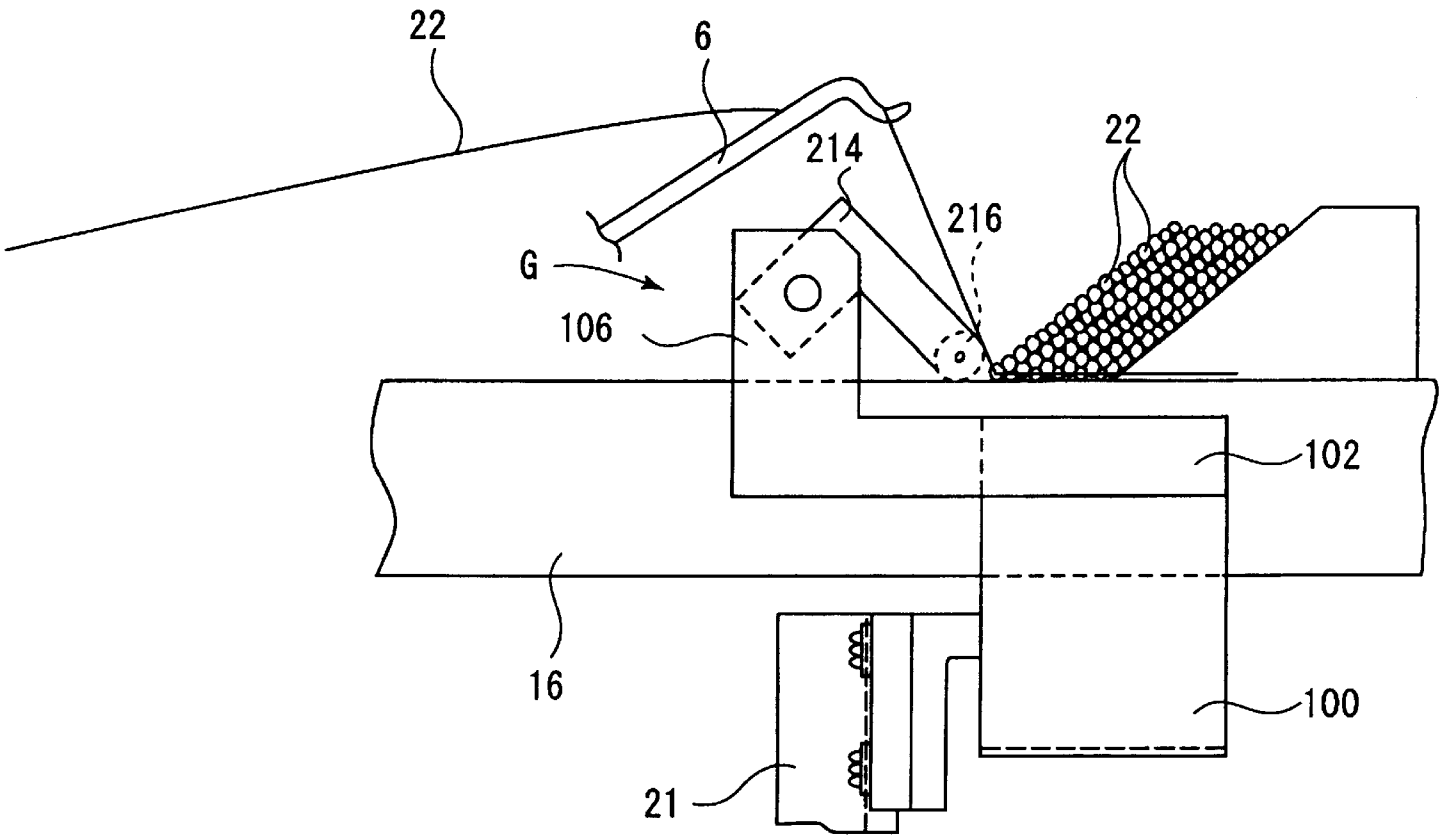
FIG. 9 is an explanatory side view of the orderly winding guide means showing the way how to guide a yarn.
Figure 10:
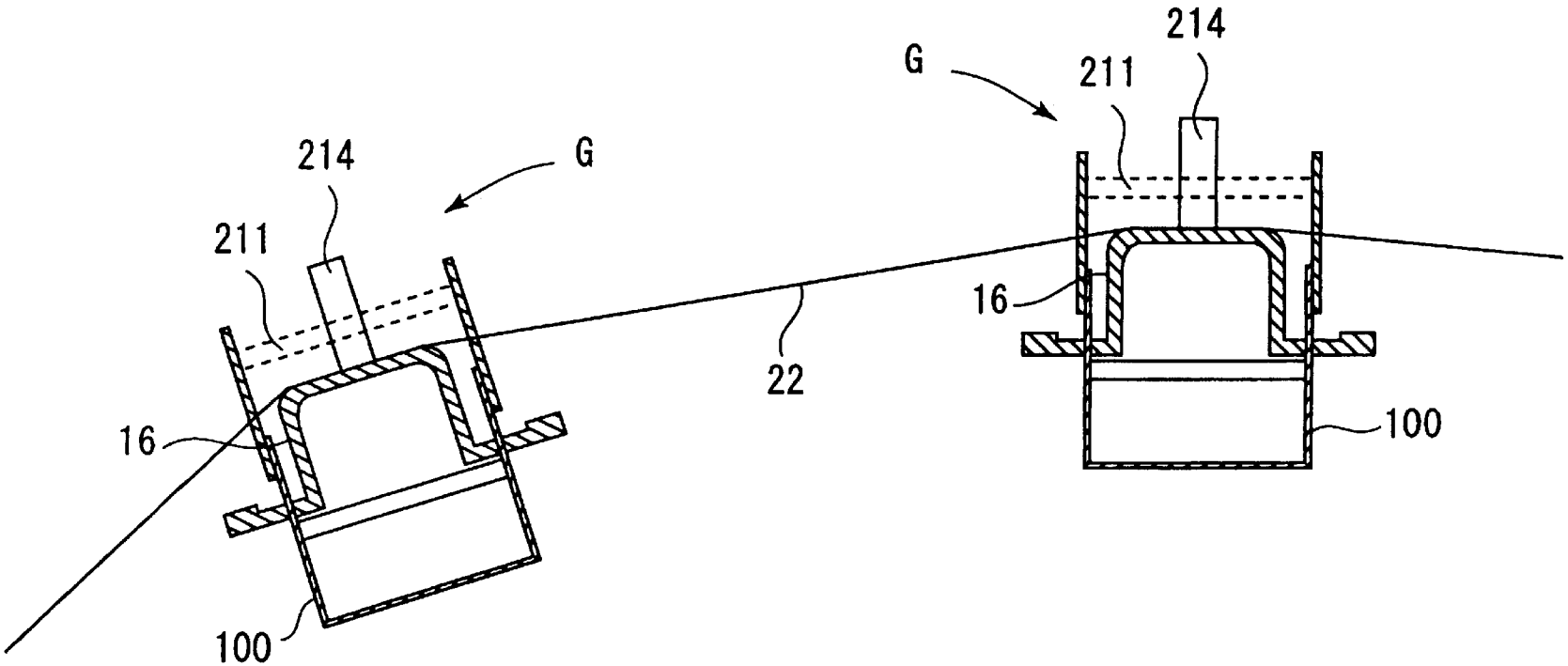
FIG. 10 is an explanatory cross-sectional view showing the manner that a yarn is wound on a drum spoke via the orderly winding guide means of the present invention.

The orderly winding guide means G, as shown in FIG. 5, includes a pair of parallel guide plates 212, 212 confronting each other and fixed on the brackets 100, a pivot 211 interconnecting the guide plate 212, 212, a guide member 214, which has a base end pivotally mounted on the pivot 211 and a tip end normally biased by a spring 213 in such a manner that a yarn- slidable upper surface 214*a* of the guide member 214 slants to the tip end downward toward the drum spoke 16, and a guide roller 216 rotatably mounted on the tip end of the guide member 214. The yarns 22 from the yarn guide member 6 slide down on the yarn-slidable surface 214*a* and are controlled by the guide roller 216 to be wound on the drum spoke 16(FIG. 9).

The bracket 100 has a channel-like configuration where a pair of side plates 110 stands vertically at opposite ends of a bottom plate 108. A pair of the guide plates 212, 212 is attached to the side plates 110 in a confronting state.

Reference numeral 112 indicates a slide base attached to movable arms 21, 21 mounted on the movable drum 1*a* and located on the inner surface side of the drum spoke 16 (FIG. 5). A guide rail 114 is mounted on the undersurface of the slide base 112. Reference numeral 116 designates a slide unit mounted on an upper surface of the bottom plate 108 of the bracket 100. The slide unit 116 is slidably attached on the guide rail 114.

To the undersurface of the bottom plate 108 of the bracket 100 is attached a rack 120 which is in mesh with a clutch gear 124 mounted on one end of a clutch shaft 122. The clutch gear 124 is engaged with and disengaged from the clutch shaft 112 by on-off operation of an electromagnetic clutch 126.

When the electromagnetic clutch 126 is on, the rotation of the clutch shaft 122 leads to the movement of the bracket 100 via the rack 120, and the guide member 214 moves on the drum spoke 16 toward the pillow member 65.

Reference numeral 128 designates a worm wheel attached to the other end of the clutch shaft 122. The worm wheel 128 is in mesh with a worm 130. Reference numeral 132 designates a bearing; and 134, a bearing case.

Figure 6:
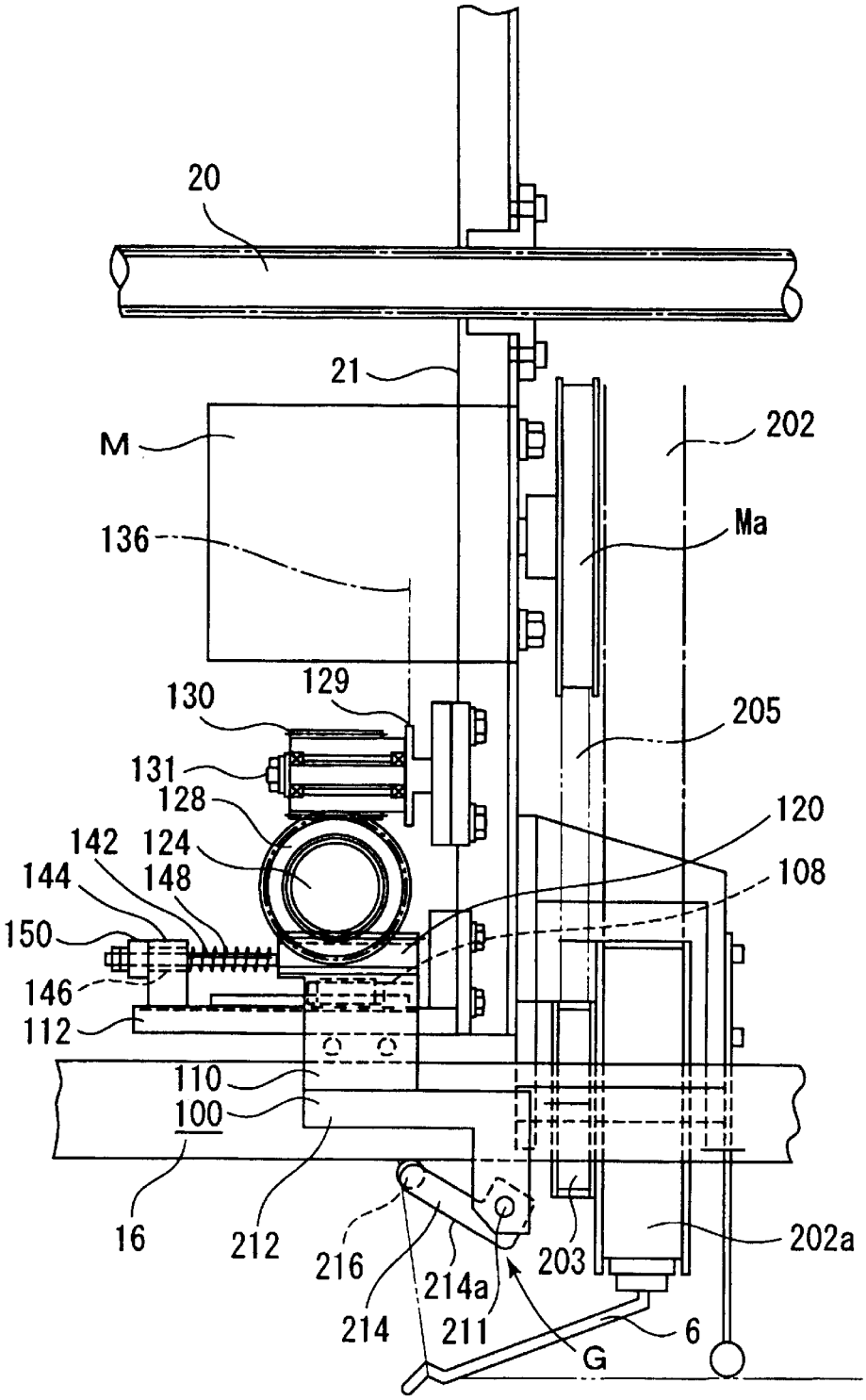
FIG. 6 is an explanatory side view of the warping guide means moving mechanism of the present invention.

The worm 130 has a worm pin 131 to which a sprocket wheel 129 is attached coaxially with the worm 130 (FIG. 6). The sprocket wheel 129 is engaged with a sprocket chain 136, which is put around an idle wheel 138 provided in correspondence with the sprocket wheel 129.

In FIG. 6, the rack 120 is connected to one end of a connecting pin 142. Reference numeral 144 designates a support member attached to the undersurface of an end portion of the slide base 112. The support member 144 has a through-hole 146 through which the other end of the connecting pin 142 is slidably inserted.

A compression coil spring 148 is disposed around the peripheral surface of the connecting pin 142 to bias the rack 120 in a direction opposite to the movement direction of the rack 120 caused by the worm wheel 128. Reference numeral 150 designates a cushion member.

As mentioned in the above, when the electromagnetic clutch 126 is on, rotation of the clutch shaft 122 causes the pitch feed of the guide member 214 against the force of the spring 148. On the contrary, when the electromagnetic clutch 126 is off, rotation of the clutch shaft 122 is not transmitted to the rack 120 so that the pitch feed of the guide member 214 does not take place. At the same time, the guide member 214 is quickly backed or returned to its original start position by the force of the spring 148. Whereas, the orderly winding guide means G moves in the longitudinal direction with the movement of the movable drum 1*a* and the movable arm 21.

Figure 7:
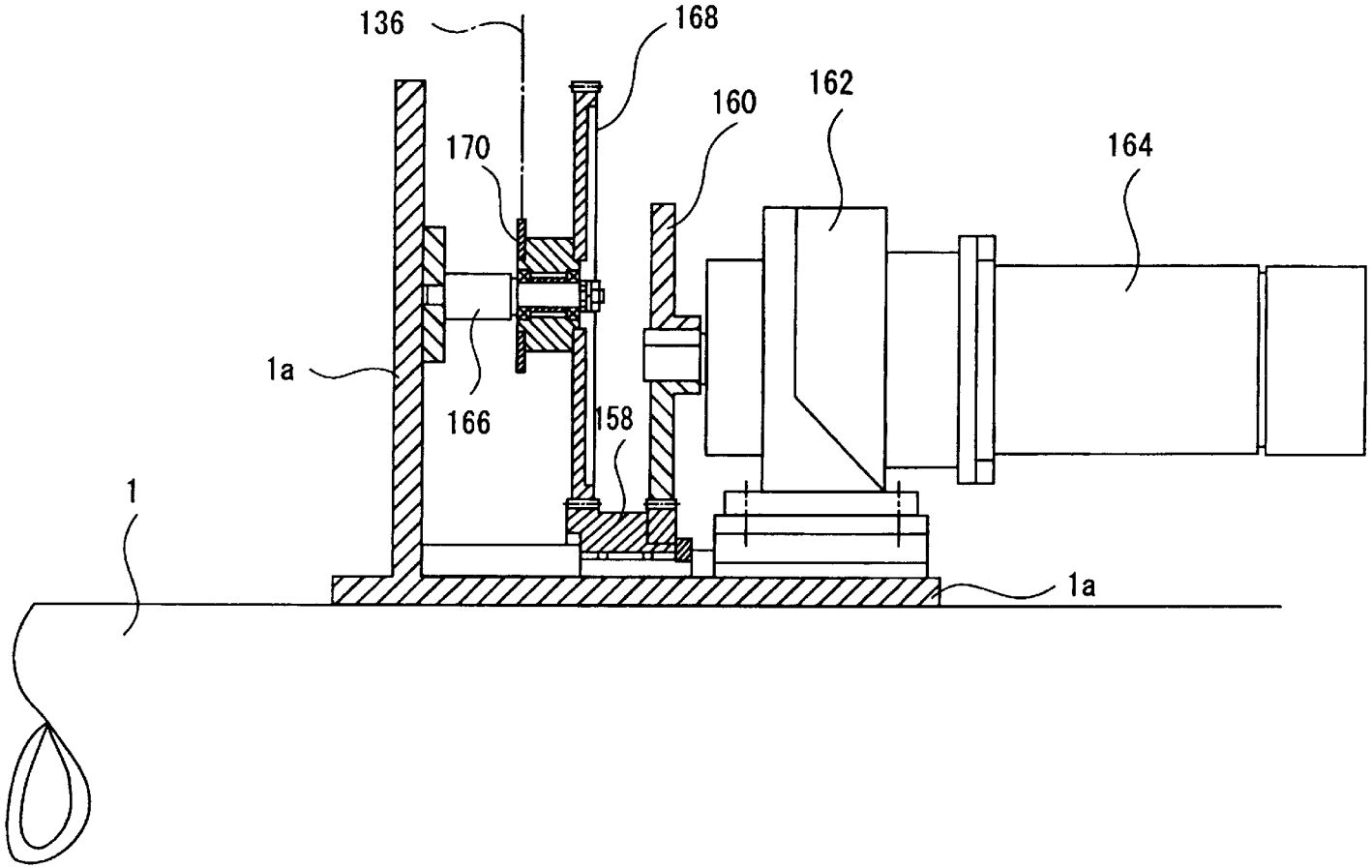
FIG. 7 is an explanatory cross-sectional view of a drive system for the orderly winding guide means showing the manner that gears mesh with each other.

In FIG. 7, a center gear 158, a servomotor 164, a speed reducer 162 and a drive gear 160 are mounted on the hub of the movable drum 1*a*. The drive gear 160 is in mesh with the center gear 158 and driven by the servomotor 164 via the speed reducer 162.

Designated by 166 is a transmission shaft attached to the movable drum 1*a*. On the distal end of the transmission shaft 166 is supported a transmission gear 168 meshing with the center gear 158. Reference numeral 170 designates a sprocket wheel mounted on a central portion of the transmission shaft 166. The above mentioned sprocket chain 136 is put around the sprocket wheel 170.

Figure 8:
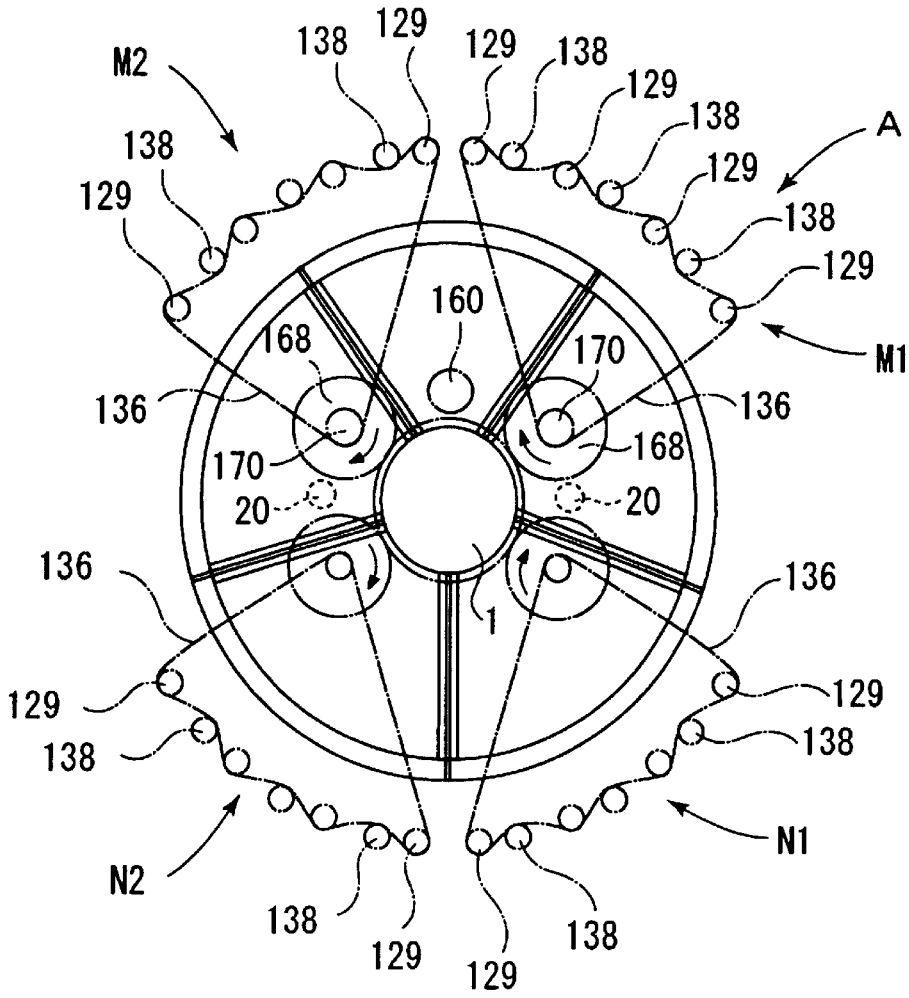
FIG. 8 is an explanatory side view, with parts omitted, of the drive system for the orderly winding guide means showing the winding state of sprocket chains.

As shown in FIG. 8, four sprocket chains each of which put around the sprocket wheels 129, the idle wheels 138, and the sprocket wheels 170 are independently provided. Specifically, four sprocket wheels 129, three idle wheels 138 and one sprocket wheel 170 are engaged with one sprocket chain 136 to form a single drive system, so that there are total four drive systems including two upper drive systems M1 and M2, and two lower drive systems N1, N2.

In FIGS. 1–3, reference numeral 65 indicates a pillow member which is attached on the upper surface of the base end of the drum spoke 16 so that a orderly winding state at the beginning of yarn winding is stable. On the upper surface of the pillow member 65, a taper surface slanting down to its tip is formed (FIG. 3). Further, as an angle of the taper surface 66 of the pillow member 65, it is preferable to adopt such an angle that the wound yarns 22 do not slide down from the taper surface 66.

Figure 11:
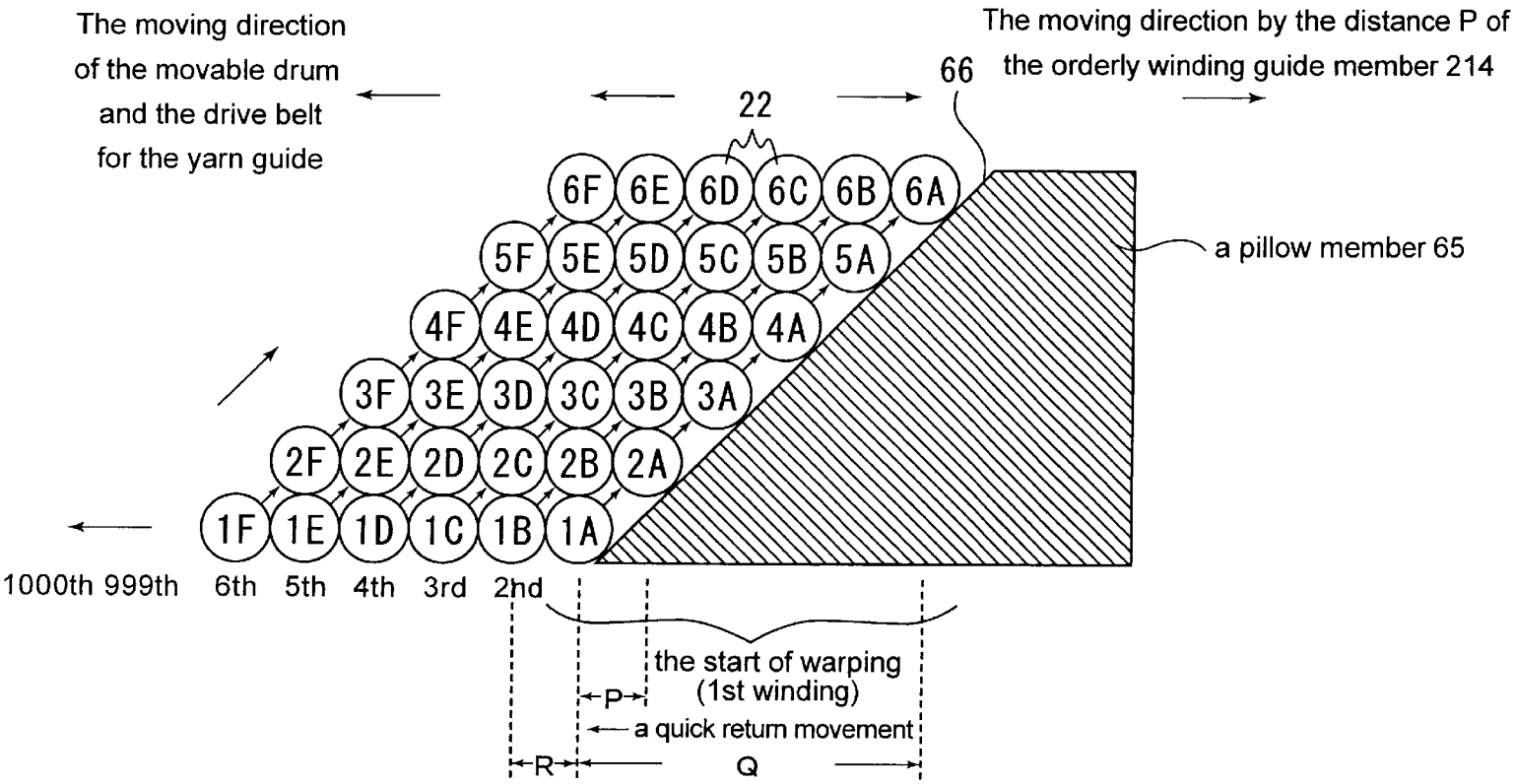
FIG. 11 is an explanatory view showing a pillow member and the way how to orderly wind a yarn.

In the construction described above, when a yarn is wound using one yarn guide member 6 of the yarn winding means 200, as illustrated in FIG. 11, the orderly winding guide member 214 is moved toward the pillow member 65 by a distance P which is at least a half of the thickness or diameter of the yarn 22 for each revolution of the yarn guide member 6, and when the number of revolutions of the yarn guide member 6 reaches a preset multi-winding value, the orderly winding guide member 214 is rapidly moved back by a distance Q which is equal to the product of the distance P and the preset multi-winding value, thus returning to its original start position. Concurrently therewith, the yarn winding means 200, the yarn selector 27, the orderly winding guide means G and the shedding means 18 are intermittently or continuously moved in time with progress of the warping on the basis of a warping yarn pitch (a warping density) R, that is, warping width÷total number of yarns (number of yarns to be warped). Thus, the yarn 22 can be wound on the warper drum A with windings of yarn neatly layered one on another in regular order.

Figure 12:
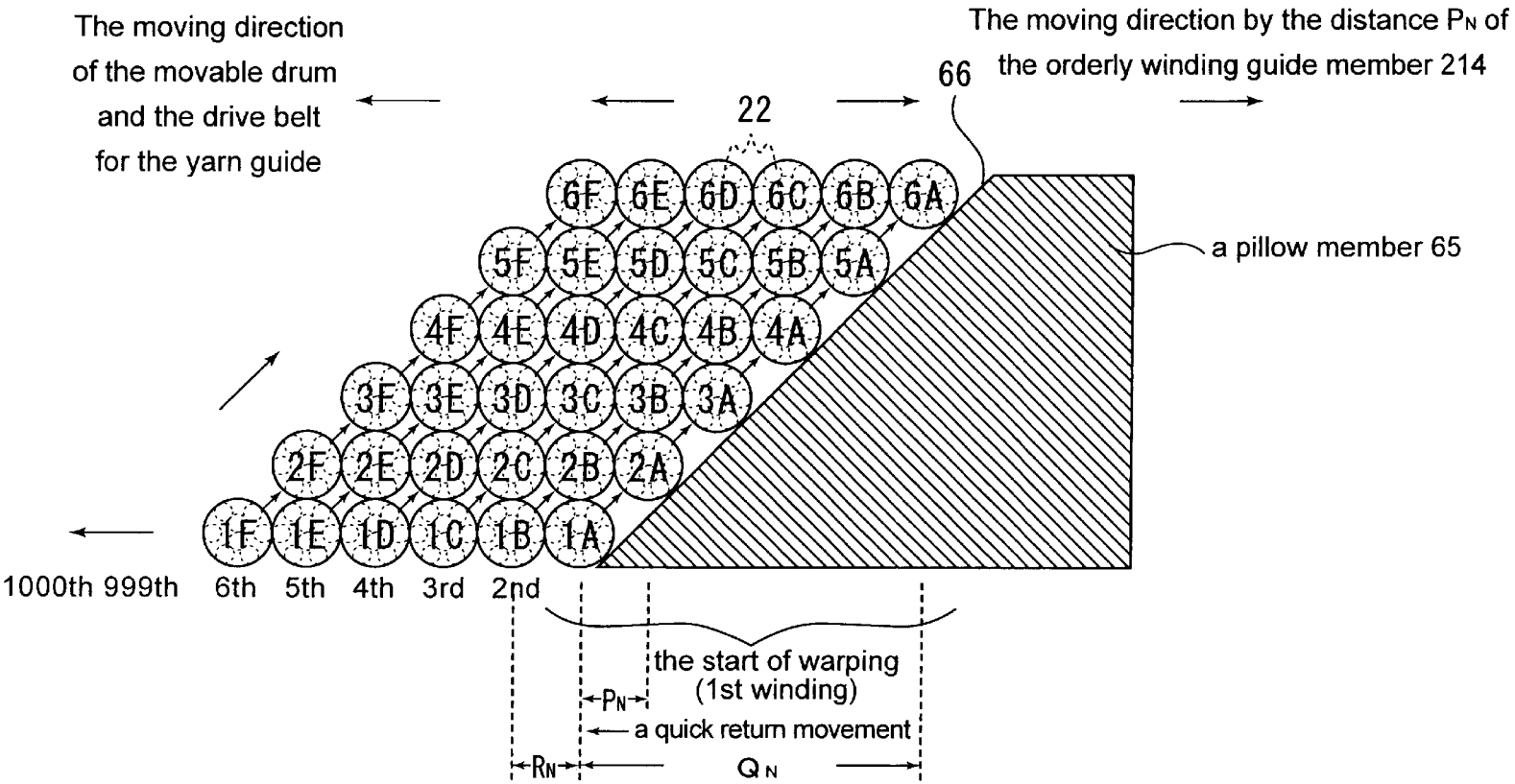
FIG. 12 is an explanatory view showing a pillow member and the way how to orderly wind a plurality of yarns.
Figure 13:
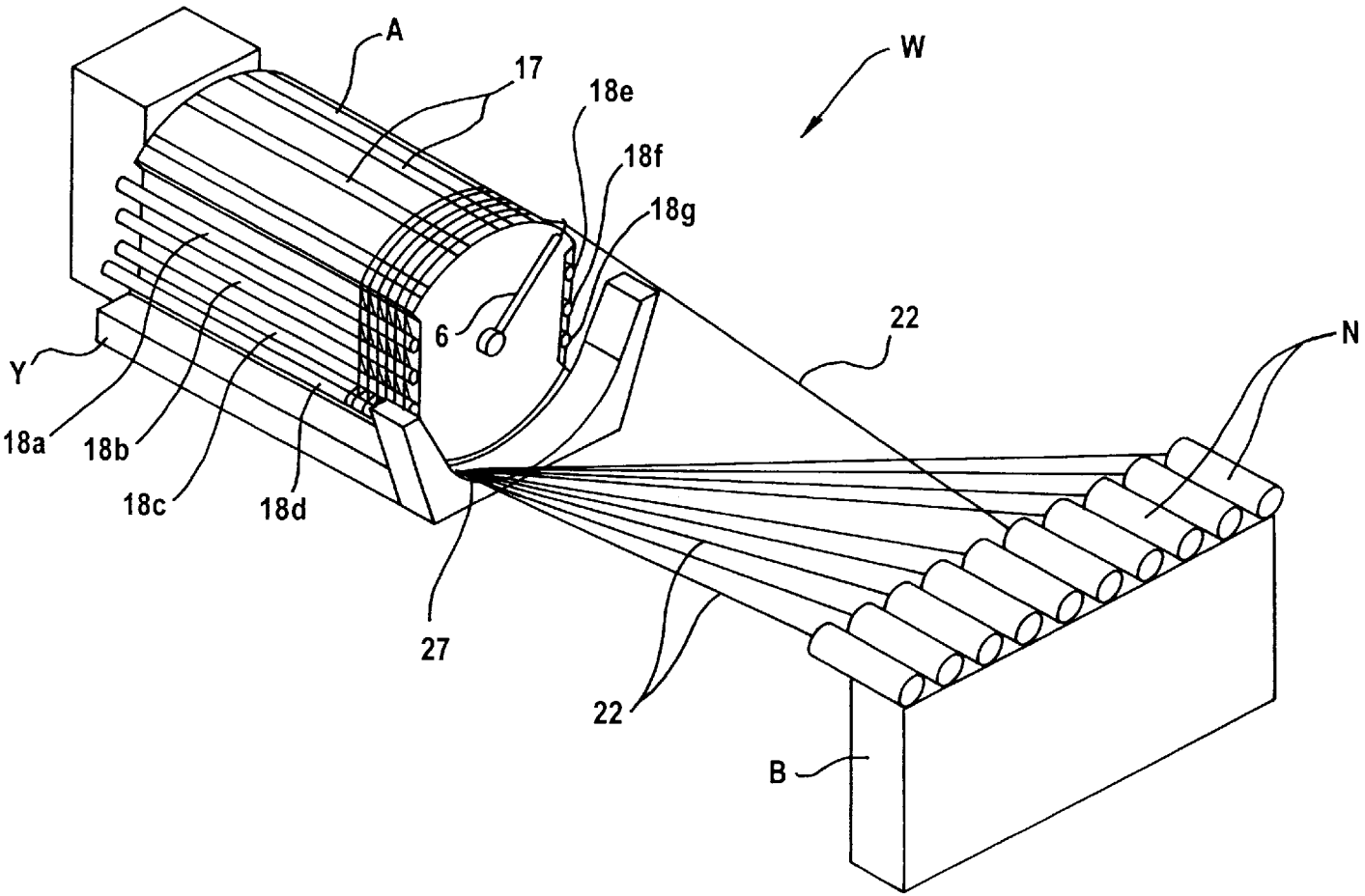
FIG.13 PRIOR ART
FIG. 13 is an explanatory perspective view showing a conventional sample warper.
Figure 14:
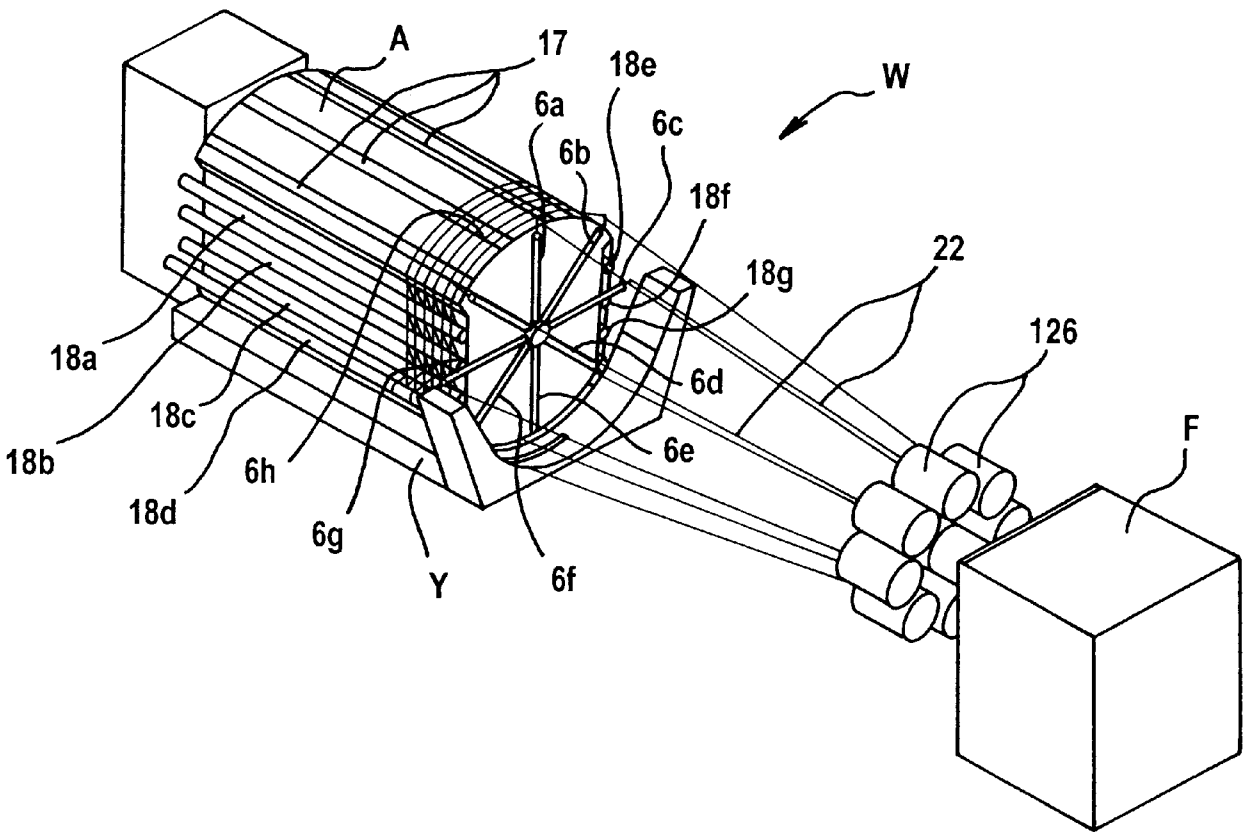
FIG.14 PRIOR ART
FIG. 14 is an explanatory perspective view showing another conventional sample warper.
Figure 15:
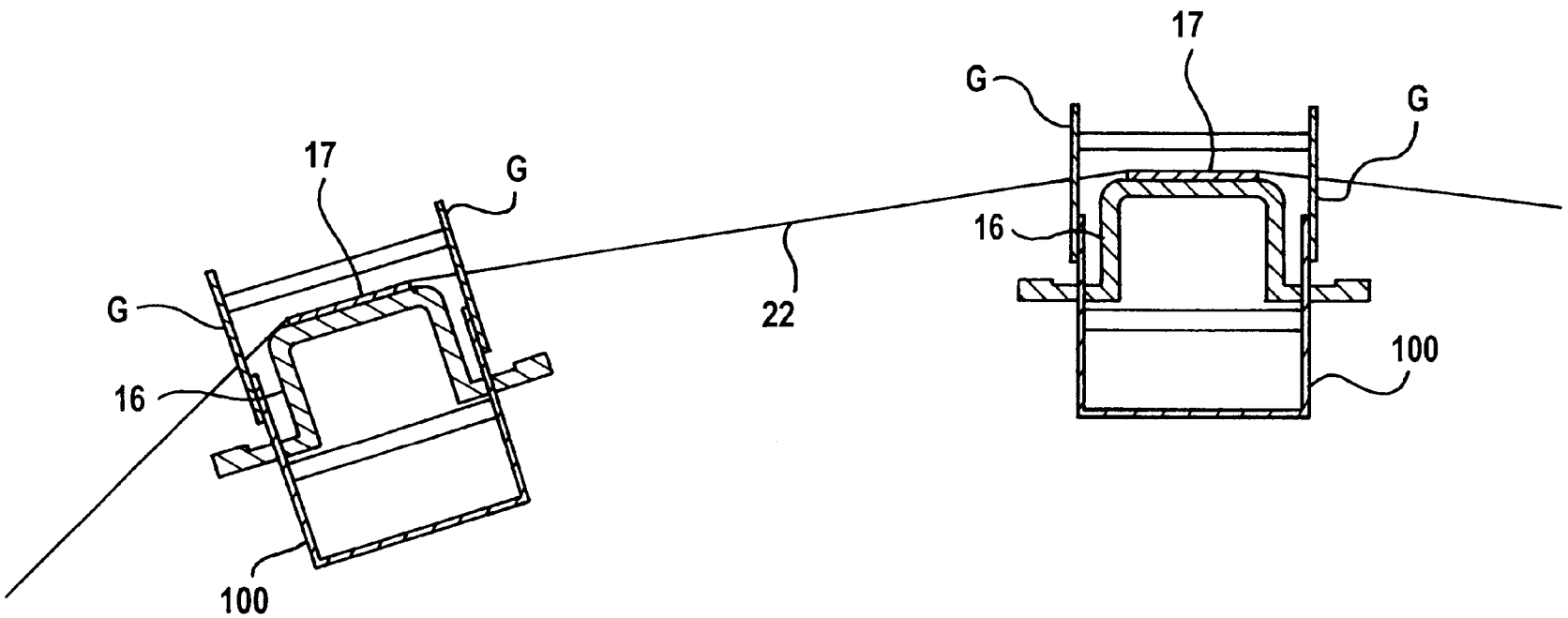
FIG.15 PRIOR ART
FIG. 15 is an explanatory cross-sectional view showing the manner that a yarn is wound on conveyer belts via guide means of the conventional sample warper.

Alternatively, when a plurality of yarns are wound using a plurality N of the yarn guide members 6 of the yarn winding means 200, as illustrated in FIG. 12 (N=8 in the illustrative embodiment), the orderly winding guide members 214 are moved toward the pillow members 65 by a distance $P_N$ which is at least a half of the thickness or diameter of a bundle of the plural yarns 22 for each revolution of the yarn guide members 6, and when the number of revolutions of the yarn guide members 6 reaches a preset multi-winding value, the orderly winding guide members 214 are rapidly moved back by a distance $Q_N$ which is equal to the product of the distance $P_N$ and the preset multi-winding value, thus returning to its original start position. Concurrently therewith, the yarn winding means 200, the yarn selector 27, the orderly winding guide means G and the shedding means 18 are intermittently or continuously moved in time with progress of the warping on the basis of a warping yarn pitch (a warping density)$R_N$, that is, warping width÷(total number of yarns÷number of yarns to be simultaneously warped N). Thus, the yarns 22 can be wound on the warper drum A with windings of yarn neatly layered one on another in regular order.

The distance P of the pitch feed of the warping guide members 214 is preferably in the range of at least a half of the thickness of the yarn 22 or the bundle of the yarns 22. The distance P may be set outside of the range specified above so long as orderly winding of the invention is possible.

In the above-described method of the present invention for winding yarns in regular order, when a first series of yarns has been wound on the warper drum with the movement of the orderly winding guide member 214, the yarn winding means 200, the yarn selector 27 and the shedding means 18, the leading yarn. of the following series of yarns begins to be wound at a position ahead of the yarns of the first series by at least the winding pitch (the warping density) R or $R_N$.

Meanwhile, needless to say, according to the sample warper of the present invention, it is possible to warp yarns without the orderly winding mechanism.

As described above, according to the present invention, yarns are wound directly on a warper drum by a yarn winding means without using a conveyer belt so that various inconveniences due to the conventional conveyer belt can be entirely eliminated, and an increase of tension that is inevitable in the conventional sample warper can be effectively reduced as well.

Obviously, various minor changes and modifications of the present invention are possible in the light of the above teaching. It is therefore to be understood that within the scope of the appended claims the invention may be practiced otherwise than as specifically described.

What is claimed is:

1. A direct-winding sample warper comprising:

a warper drum;

yarn winding means mounted on a circumferential surface of said warper drum so as to be rotatable circumferentially and movable longitudinally on said warper drum;

a yarn selector provided in correspondence to said yarn winding means and movable in synchronism with the longitudinal movement of said yarn winding means; and a plurality of parallel shedding means extending longitudinally and parallel each other on the side of said warper drum and movable in synchronism with the longitudinal movement of said yarn winding means;

wherein said yarn winding means is operable to directly wind at least one yarn, which is payed out from a creel on which bobbins are supported, around the circumferential surface of said warper drum.

2. A direct-winding sample warper according to claim 1, wherein said circumferential surface of said warper drum is defined by a plurality of drum spokes, each of said drum spokes having at its base end an outer surface on which a pillow member having a taper surface slanting down to its tip is disposed.

3. A direct-winding sample warper according to claim 1 or 2, wherein said winding the yarn around said circumferential surface of said warper drum starts from said pillow members on the respective bases of said drum spokes and terminates at other ends of said drum spokes remote from said pillow members.

4. A direct-winding sample warper according to claim 1 or 2, wherein said yarn winding means includes at least one yarn guide member attached to a drive belt or chain circumferentially rotatably mounted on said circumferential surface of said warper drum.

5. A direct-winding sample warper according to claim 1 or 2, wherein said yarn selector transfers the yarn from the creel between said yarn selector and said yarn guide members in accordance with previously input pattern data by delivering the yarn to said yarn guide members and receiving the yarn from said yarn guide members.

6. A direct-winding sample warper according to claim 1 or 2, wherein said yarn winding means is associated with orderly winding guide means each having an orderly winding guide member longitudinally slidably mounted on said warper drum.

7. A direct-winding sample warper according to claim 1, wherein when a yarn is wound using said yarn guide member of said yarn winding means, said yarn winding means, said yarn selector, the orderly winding guide means and the shedding means are intermittently or continuously moved in time with progress of the warping on the basis of a warping yarn pitch R, that is, warping width÷total number of yarns (number of yarns to be warped).

8. A direct-winding sample warper according to claim 2, wherein when a yarn is wound using said yarn guide member of said yarn winding means, said yarn winding means, said yarn selector, the orderly winding guide means and the shedding means are intermittently or continuously moved in time with progress of the warping on the basis of a warping yarn pitch R, that is, warping width÷total number of yarns (number of yarns to be warped).

9. A direct-winding sample warper according to claim 3, wherein when a yarn is wound using said yarn guide member of said yarn winding means, said yarn winding means, said yarn selector, the orderly winding guide means and the shedding means are intermittently or continuously moved in time with progress of the warping on the basis of a warping yarn pitch R, that is, warping width÷total number of yarns (number of yarns to be warped).

10. A direct-winding sample warper according to claim 4, wherein when a yarn is wound using said yarn guide member of said yarn winding means, said yarn winding means, said yarn selector, the orderly winding guide means and the shedding means are intermittently or continuously moved in time with progress of the warping on the basis of a warping yarn pitch R, that is, warping width÷total number of yarns (number of yarns to be warped).

11. A direct-winding sample warper according to claim 5, wherein when a yarn is wound using said yarn guide member of said yarn winding means, said yarn winding means, said yarn selector, the orderly winding guide means and the shedding means are intermittently or continuously moved in time with progress of the warping on the basis of a warping yarn pitch R, that is, warping width÷total number of yarns (number of yarns to be warped).

12. A direct-winding sample warper according to claim 6, wherein when a yarn is wound using said yarn guide member of said yarn winding means, said yarn winding means, said yarn selector, the orderly winding guide means and the shedding means are intermittently or continuously moved in time with progress of the warping on the basis of a warping yarn pitch R, that is, warping width÷total number of yarns (number of yarns to be warped).

13. A direct-winding sample warper according to claim 1, wherein when a plurality of yarns are wound using a plurality of yarn guide members of said yarn winding means, said yarn winding means, said yarn selector, said orderly winding guide means and said shedding means are intermittently or continuously moved in time with progress of the warping on the basis of a warping yarn pitch $R_N$, that is, warping width÷(total number of yarns÷number of yarns to be simultaneously warped N).

14. A direct-winding sample warper according to claim 2, wherein when a plurality of yarns are wound using a plurality of yarn guide members of said yarn winding means, said yarn winding means, said yarn selector, said orderly winding guide means and said shedding means are intermittently or continuously moved in time with progress of the warping on the basis of a warping yarn pitch $R_N$, that is, warping width÷(total number of yarns÷number of yarns to be simultaneously warped N).

15. A direct-winding sample warper according to claim 3, wherein when a plurality of yarns are wound using a plurality of yarn guide members of said yarn winding means, said yarn winding means, said yarn selector, said orderly winding guide means and said shedding means are intermittently or continuously moved in time with progress of the warping on the basis of a warping yarn pitch $R_N$, that is, warping width÷(total number of yarns÷number of yarns to be simultaneously warped N).

16. A direct-winding sample warper according to claim 4, wherein when a plurality of yarns are wound using a plurality of yarn guide members of said yarn winding means, said yarn winding means, said yarn selector, said orderly winding guide means and said shedding means are intermittently or continuously moved in time with progress of the warping on the basis of a warping yarn pitch $R_N$, that is, warping width÷(total number of yarns÷number of yarns to be simultaneously warped N).

17. A direct-winding sample warper according to claim 5, wherein when a plurality of yarns are wound using a plurality of yarn guide members of said yarn winding means, said yarn winding means, said yarn selector, said orderly winding guide means and said shedding means are intermittently or continuously moved in time with progress of the warping on the basis of a warping yarn pitch $R_N$, that is, warping width÷(total number of yarns÷number of yarns to be simultaneously warped N).

18. A direct-winding sample warper according to claim 6, wherein when a plurality of yarns are wound using a plurality of yarn guide members of said yarn winiding means, said yarn winding means, said yarn selector, said orderly winding guide means and said shedding means are intermittently or continuously moved in time with progress of the warping on the basis of a warping yarn pitch $R_N$, that is, warping width÷(total number of yarns÷number of yarns to be simultaneously warped N).

19. A direct-winding sample warper according to claim 7, wherein when a yarn is wound using one yarn guide member of said yarn winding means, said orderly winding guide member is moved toward said pillow member by a distance P which is at least a half of the thickness of the yarn for each revolution of the yarn guide member, and when the number of revolutions of the yarn guide member reaches a preset multi-winding value, said orderly winding guide members are rapidly moved back by a distance Q which is equal to the product of the distance P and the preset multi-winding value, whereby the yarn is successively wound neatly on said warper drum in regular order.

20. A direct-winding sample warper according to claim 8, wherein when a yarn is wound using one yarn guide member of said yarn winding means, said orderly winding guide member is moved toward said pillow member by a distance P which is at least a half of the thickness of the yarn for each revolution of the yarn guide member, and when the number of revolutions of the yarn guide member reaches a preset multi-winding value, said orderly winding guide members are rapidly moved back by a distance Q which is equal to the product of the distance P and the preset multi-winding value, whereby the yarn is successively wound neatly on said warper drum in regular order.

21. A direct-winding sample warper according to claim 9, wherein when a yarn is wound using one yarn guide member of said yarn winding means, said orderly winding guide member is moved toward said pillow member by a distance P which is at least a half of the thickness of the yarn for each revolution of the yarn guide member, and when the number of revolutions of the yarn guide member reaches a preset multi-winding value, said orderly winding guide members are rapidly moved back by a distance Q which is equal to the product of the distance P and the preset multi-winding value, whereby the yarn is successively wound neatly on said warper drum in regular order.

22. A direct-winding sample warper according to claim 10, wherein when a yarn is wound using one yarn guide member of said yarn winding means, said orderly winding guide member is moved toward said pillow member by a distance P which is at least a half of the thickness of the yarn for each revolution of the yarn guide member, and when the number of revolutions of the yarn guide member reaches a preset multi-winding value, said orderly winding guide members are rapidly moved back by a distance Q which is equal to the product of the distance P and the preset multi-winding value, whereby the yarn is successively wound neatly on said warper drum in regular order.

23. A direct-winding sample warper according to claim 11, wherein when a yarn is wound using one yarn guide member of said yarn winding means, said orderly winding guide member is moved toward said pillow member by a distance P which is at least a half of the thickness of the yarn for each revolution of the yarn guide member, and when the number of revolutions of the yarn guide member reaches a preset multi-winding value, said orderly winding guide members are rapidly moved back by a distance Q which is equal to the product of the distance P and the preset multi-winding value, whereby the yarn is successively wound neatly on said warper drum in regular order.

24. A direct-winding sample warper according to claim 12, wherein when a yarn is wound using one yarn guide member of said yarn winding means, said orderly winding guide member is moved toward said pillow member by a distance P which is at least a half of the thickness of the yarn for each revolution of the yarn guide member, and when the number of revolutions of the yarn guide member reaches a preset multi-winding value, said orderly winding guide members are rapidly moved back by a distance Q which is equal to the product of the distance P and the preset multi-winding value, whereby the yarn is successively wound neatly on said warper drum in regular order.

25. A direct-winding sample warper according to claim 13, wherein when a plurality of yarns are wound using a plurality of yarn guide members to of said yarn winding means, said orderly winding guide members are moved toward said pillow members by a distance $P_N$ which is at least a half of the thickness of a bundle of the plural yarns for each revolution of the yarn guide members, and when the number of revolutions of the yarn guide members reaches a preset multi-winding value, said warping guide members are rapidly moved back by a distance $Q_N$ which is equal to the product of the distance $P_N$ and the preset multi-winding value, whereby the yarns are successively wound neatly on said warper drum in regular order.

26. A direct-winding sample warper according to claim 14, wherein when a plurality of yarns are wound using a plurality of yarn guide members of said yarn winding means, said orderly winding guide members are moved toward said pillow members by a distance $P_N$ which is at least a half of the thickness of a bundle of the plural yarns for each revolution of the yarn guide members, and when the number of revolutions of the yarn guide members reaches a preset multi-winding value, said warping guide members are rapidly moved back by a distance $Q_N$ which is equal to the product of the distance $P_N$ and the preset multi-winding value, whereby the yarns are successively wound neatly on said warper drum in regular order.

27. A direct-winding sample warper according to claim 15, wherein when a plurality of yarns are wound using a plurality of yarn guide members of said yarn winding means, said orderly winding guide members are moved toward said pillow members by a distance $P_N$ which is at least a half of the thickness of a bundle of the plural yarns for each revolution of the yarn guide members, and when the number of revolutions of the yarn guide members reaches a preset multi-winding value, said warping guide members are rapidly moved back by a distance $Q_N$ which is equal to the product of the distance $P_N$ and the preset multi-winding value, whereby the yarns are successively wound neatly on said warper drum in regular order.

28. A direct-winding sample warper according to claim 16, wherein when a plurality of yarns are wound using a plurality of yarn guide members of said yarn winding means, said orderly winding guide members are moved toward said pillow members by a distance $P_N$ which is at least a half of the thickness of a bundle of the plural yarns for each revolution of the yarn guide members, and when the number of revolutions of the yarn guide members reaches a preset multi-winding value, said warping guide members are rapidly moved back by a distance $Q_N$ which is equal to the product of the distance $P_N$ and the preset multi-winding value, whereby the yarns are successively wound neatly on said warper drum in regular order.

29. A direct-winding sample warper according to claim 17, wherein when a plurality of yarns are wound using a plurality of yarn guide members of said yarn winding means, said orderly winding guide members are moved toward said pillow members by a distance $P_N$ which is at least a half of the thickness of a bundle of the plural yarns for each revolution of the yarn guide members, and when the number of revolutions of the yarn guide members reaches a preset multi-winding value, said warping guide members are rapidly moved back by a distance $Q_N$ which is equal to the product of the distance $P_N$ and the preset multi-winding value, whereby the yarns are successively wound neatly on said warper drum in regular order.

30. A direct-winding sample warper according to claim 18, wherein when a plurality of yarns are wound using a plurality of yarn guide members of said yarn winding means, said orderly winding guide members are moved toward said pillow members by a distance $P_N$ which is at least a half of the thickness of a bundle of the plural yarns for each revolution of the yarn guide members, and when the number of revolutions of the yarn guide members reaches a preset multi-winding value, said warping guide members are rapidly moved back by a distance $Q_N$ which is equal to the product of the distance $P_N$ and the preset multi-winding value, whereby the yarns are successively wound neatly on said warper drum in regular order.

* * * * *